US006848859B2

(12) United States Patent
Carston

(10) Patent No.: US 6,848,859 B2
(45) Date of Patent: Feb. 1, 2005

(54) COMPOSITE POND APPARATUS

(76) Inventor: Raymond Carston, 31843 Outer Hwy. 10, Redlands, CA (US) 97373

( * ) Notice: Subject to any disclaimer, the term of this patent is extended or adjusted under 35 U.S.C. 154(b) by 0 days.

(21) Appl. No.: 09/884,529

(22) Filed: Jun. 18, 2001

(65) Prior Publication Data

US 2002/0192028 A1 Dec. 19, 2002

(51) Int. Cl.[7] ..... B65G 5/00
(52) U.S. Cl. ..... 405/53; 405/52
(58) Field of Search ..... 405/52, 53, 55, 405/129.7; 119/259, 226, 73, 74, 61, 78; 404/25, 26

(56) References Cited

U.S. PATENT DOCUMENTS 3,566,839 A 3/1971 Hilble
4,066,400 A 1/1978 Cox et al.
4,264,674 A 4/1981 Kumins et al.
4,277,533 A 7/1981 Kumins et al.
4,395,974 A * 8/1983 Schafer et al. ..... 119/73
4,451,173 A 5/1984 Watson et al.
4,514,463 A 4/1985 Alteepping et al.
4,962,730 A * 10/1990 Schafer ..... 119/73
4,986,699 A 1/1991 Bohnhoff
5,307,388 A 4/1994 Inkester et al.

* cited by examiner

*Primary Examiner*—Heather Shackelford
*Assistant Examiner*—Sunil Singh
(74) *Attorney, Agent, or Firm*—Denton L. Anderson; Sheldon & Mak

(57) ABSTRACT

A lightweight composite pond for supporting a fountain in water includes a shell member having a floor portion and wall portions that are reinforced by a lightweight hardened foam core material, and a reinforcing panel that is bonded under a portion of the floor portion that is to receive the fountain. Water is pumped from the pond into the fountain through a conduit that extends through the reinforcing panel. Also disclosed are a modular mold structure and a method for forming the pond in a variety of shapes.

24 Claims, 3 Drawing Sheets

COMPOSITE POND APPARATUS

BACKGROUND

The present invention relates to garden pond structures, and more particularly to such structures having loads such as fountain sculptures located therein.

Typical garden ponds are constructed as small-scale swimming pools, having a reinforced concrete shell set on or buried in the ground, interior surfaces of the shell typically having a plaster coating. Often it is desired to have a fountain in such a pond, and it is also desired to avoid the expense of forming the reinforced concrete shell in situ. However, portable vessels suitable for ponds are unsuitable for a number of reasons. For example:

1. They do not have sufficient strength to support high load concentrations that are typical of fountain devices;

2. They are excessively heavy to be transported except in very small sizes; and

3. Modular construction involves excessive onsite labor expense.

Thus there is a need for a lightweight and portable pond structure that is generously sized and capable of supporting a rigid heavy load such as a fountain, and is also inexpensive to provide.

SUMMARY

The present invention meets this need by providing a lightweight composite pond apparatus that is particularly effective for supporting a heavy water fountain. In one aspect of the invention, the apparatus includes a shell member having a floor portion and an upstanding inside wall portion; a lightweight core material bonded to the shell member under the floor portion and outside of the wall portion thereof; and a panel member extending within the core material for reinforcing the floor portion of the shell member under the rigid load member. The shell member can also have a rim portion projecting outwardly from the inside wall portion, and an outside wall portion extending downwardly from an outer perimeter of the rim portion, the core material also being bonded to the rim and outside wall portions of the shell member. Preferably a protective base skin extends under the panel member and covers the underside of the core material, the base skin being sealingly bonded to the core material and the outside wall portion of the shell member. The base skin can include sand dispersed in a hardened polymer, which can include a material selected from the group consisting of urethane, polyester resin and epoxy.

The outside wall portion of the shell member can have a variety of shapes. For example, a first region of the outside wall portion can slope downwardly and inwardly for producing a decorative appearance, and a second region can slope downwardly and outwardly below the first region for enhancing the decorative appearance.

The shell member can include a hardened polymeric paste. A granulated material and/or fiberglass fibers can be dispersed in the paste. It will be understood that the fiberglass fibers can be those of a woven fiberglass cloth that is permeated with the paste, which can include a two-part casting urethane. The lightweight core material can include a hardened foam polymer, which can be selected from the group consisting of urethane foam and Styrofoam.

A passage is preferably formed through the floor portion of the shell member at a location being over the panel member, the passage extending within the panel member for carrying a liquid to be dispensed from the load, such as a fountain. The passage can be formed within a tubular member that sealingly projects through the floor portion of the shell member. Preferably the passage extends laterally from the panel member, within the core material, and again through the floor portion of the shell member at a location laterally displaced from the panel member for passage of the liquid from a supply of the liquid being contained by the shell member. The pond apparatus can also include a submersible pump having an outlet, and means for fluid-connecting the outlet to the passage at the location laterally displaced from the panel member. The term "submersible pump" is defined as a pump having a fluid-connected submersible inlet for receiving the liquid contained by the shell member. A service conduit can be sealingly connected to the inside wall portion of the shell member, extending outwardly therefrom for receiving a power cord of the pump to be connected through the conduit to an external source of electrical power.

In another aspect of the invention, a mold structure for forming a composite pond structure includes a platform having a plurality of fastener openings therethrough; a mold core for fastening to the platform using fasteners that engage some of the fastener openings, top and side surfaces of the mold core defining respective floor and inside wall portions of the (inverted) shell structure; a mold ring for fastening to the platform in spaced relation surrounding the mold core, an inside surface of the mold ring defining an outside wall portion of the shell structure, and an annular portion of the platform defining the rim portion of the shell structure. As used herein, the term "fastener" is defined to include a registration pin projecting upwardly from the platform, in combination with means for holding elements of the mold core and/or the mold ring against the platform. Preferably the mold structure is modular, with the mold ring having a plurality of ring segments for facilitating removal of the ring from the shell member after it has hardened. Also, the modular construction facilitates handling and storage of the mold structure in that the platform can be used with different mold core and ring components to facilitate fabrication of the pond structure in a variety of shapes.

Further, the mold core is preferably assembled from a plurality of core segments, being selectively configurable to form different plan profiles of the inside wall portion of the shell member using respective subsets of the core segments; and the ring segments also having a plurality of configurations and being sufficient in number for arrangement of a subset of the ring segments on the platform in approximate uniformly spaced relation to the different plan profiles of the inside wall portion of the shell member, the ring segments being adapted for fastening to the platform using additional fasteners that engage additional fastener openings. In particular, the mold core segments can include a mating pair of semicircular core segments and a rectangular core segment for matching placement against one of the semicircular core segments; and the ring segments can include an even number of arcuate ring segments for forming the mold ring circularly configured for use with the pair of semicircular core segments, and a further complement of the ring segments can include any of a pair of corner ring segments; a pair of corner ring segments and at least one straight ring segment; and a C-shaped ring segment that includes an integrally formed pair of corner ring segments. Thus the further complement of ring segments can be used in combination with half of the even number of arcurate ring segments to form the mold ring in a D-shaped configuration that is spaced from and surrounds the combination of the rectangular core segment and the one semicircular mold segment.

In another aspect of the modular mold structure, the core segments include a mating pair of end core segments and a rectangular center core segment for matching placement between the end core segments; and the ring segments include a plurality of ring segments for forming the mold ring configured for use with the pair of end core segments, and a plurality of straight ring segments for forming the mold ring in an elongate configuration spaced from and surrounding the combination of the end core segments and the center mold segment. It will be understood that the end core segments can be semicircular and/or rectangular, or of other shapes having a straight side that mates with an adjacent mold core segment.

In a further aspect of the invention, a method for forming the composite pond structure includes:

(a) providing a mold structure having a raised core portion, a rim portion surrounding the core portion, and a ring portion projecting upwardly along an outside perimeter of the rim portion beyond the core portion;

(b) applying a paste covering the core portion, the rim portion, and an inside surface of the ring portion;

(c) solidifying the paste to form a shell member having a floor portion and an inside wall portion covering the core portion of the mold structure, a rim portion covering the rim portion of the mold structure, and an outside wall portion covering the inside surface of the ring portion, the rim portion connecting the inside and outside wall portions;

(d) bonding a reinforcing panel to the floor portion of the shell structure opposite the core portion of the mold structure, the reinforcing panel covering a portion only of the floor portion;

(e) filling the shell member between the inside and outside wall portions, and between the reinforcing panel and the outside wall portion, with a foam composition;

(f) solidifying the foam composition to form a core member bonded to the shell member; and (g) removing the completed composite pond structure from the mold structure.

The method can further include applying a skin composition covering exposed surfaces of the core member and the reinforcing panel, and solidifying the skin composition to form a protective base skin of the pond structure. The applying of the skin composition can include dispersing glass fibers and a granulated material (which can include high and low density sand which can be silica sand, silver sand and ceramic sand) in the paste.

The method can also include:

(a) providing a platform member, a mold core, and a plurality of mold ring segments;

(b) mounting the mold core on the platform to form the core and rim portions of the mold structure; and (c) mounting at least some of the mold ring segments on the platform in spaced relation to the mold core to form the ring portion of the mold structure.

The method can preferably facilitate production of the pond structure in different shapes, by:

(a) providing a plurality of mold core segments;

(b) selecting a first subset of the mold core segments to form the mold core;

(c) selecting a first subset of the mold ring segments to form the ring portion of the mold structure prior to completing a first pond structure;

(d) selecting a second subset of the mold core segments and to form the mold core in a different configuration; and (e) selecting a second subset of the mold ring segments to form the ring portion of the mold structure in a corresponding different configuration prior to completing a second pond structure having a configuration different from that of the first pond structure.

Preferably the method also includes forming the fluid passage extending downwardly through the floor portion of the shell member and through the reinforcing panel for feeding the liquid to a device (the fountain) being supported on the floor portion of the shell member above the reinforcing panel.

DRAWINGS

These and other features, aspects, and advantages of the present invention will become better understood with reference to the following description, appended claims, and accompanying drawings, where:

DESCRIPTION

Figure 1:
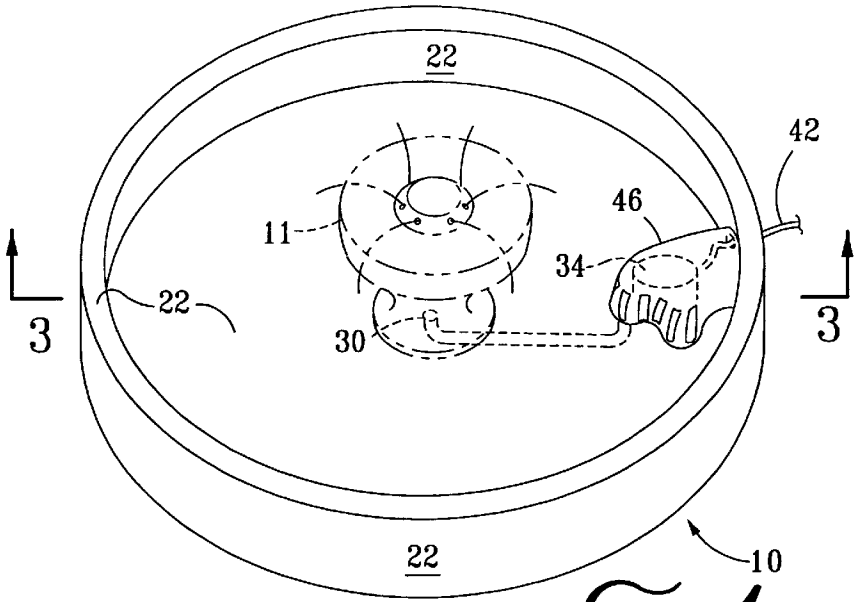
FIG. 1 is a fragmentary sectional perspective view of a portable pond apparatus having a water fountain installed therein according to the present invention.
Figure 2:
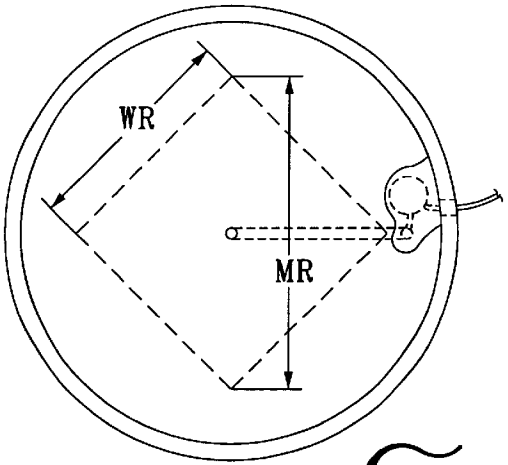
FIG. 2 is a plan view of the pond apparatus of FIG. 1.
Figure 3:
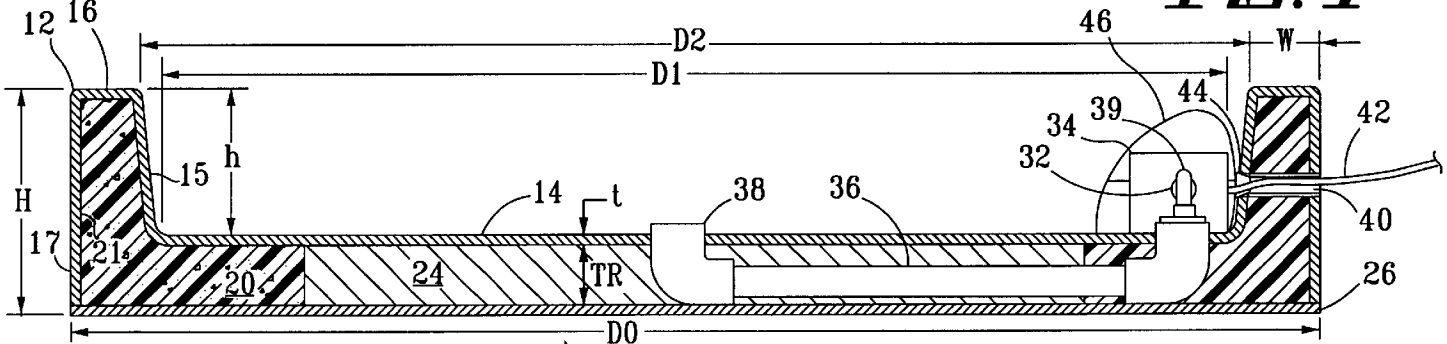
FIG. 3 is a sectional elevational view of the pond apparatus of FIG. 1 on line 3—3 therein.

The present invention is directed to a portable pond structure that is particularly effective in accommodating a heavy load such as a fountain sculpture. With reference to FIGS. 1–3 of the drawings, a pond structure 10 includes a shell member 12 having a floor portion 14 an inside wall portion 15, a rim portion 16, and an outside wall portion 17. A lightweight core 20 is bonded to an inside surface 21 of the shell member 12, the surface 21 extending on facing sides of the wall portions 15 and 17 and the undersides of the floor portion 14 and the rim portion 16 as shown in FIG. 3. An outside surface 22 of the shell member 12 extends on the outside of the outside wall portion 17, the top of the rim portion 16, the inside of the inside wall portion 15, and the top of the floor portion 14 as shown in FIG. 1, the floor portion and the inside wall portion providing liquid containment.

Figure 8:
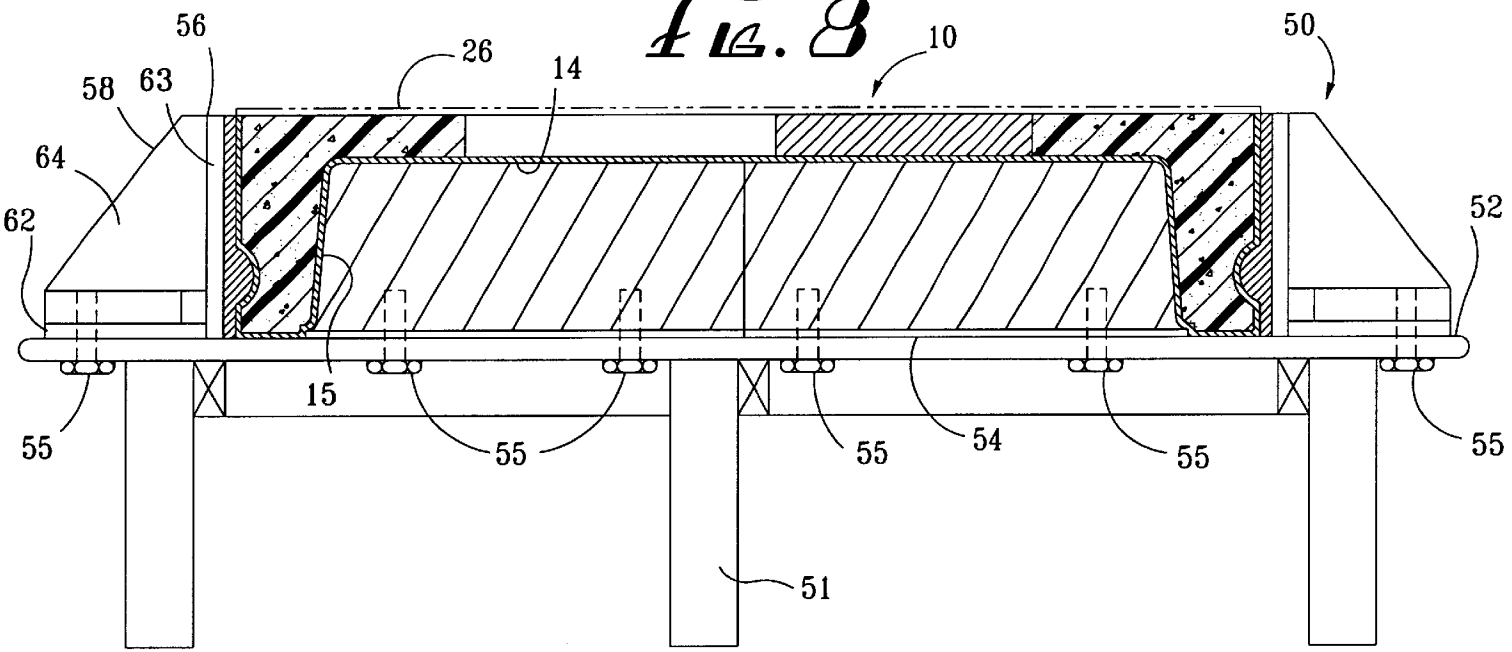
FIG. 8 is a sectional view on line 8—8 in FIG. 4, showing the pond apparatus of FIG. 1 partially completed.

A rigid reinforcing panel 24 having a thickness TR is imbedded in the core 20, the panel being bonded to the floor portion 14 of the shell member 12 for locally reinforcing same. As shown in FIG. 3, the shell member 12 has a nominal thickness t being typically approximately 0.25 inch, an inside diameter d1 proximate the floor portion 14, and an inside diameter d2 proximate the rim portion 18, an average inside diameter d being the average of d1 and d2 when the wall portions 16 slope approximately linearly. The shell member 12 also has an inside height h, the rim portion 18 projecting outwardly to a width w from the inside diameter d2. Optionally, the outside wall portion 17 can be contoured as shown in FIG. 8 and indicated at 60 in FIG. 10.

The core 20 extends approximately to a lower extremity of the outside wall portion 17, and a base skin 26 covers the underside of the core 20, the pond apparatus 10 having an outside diameter DO and a height H that is inclusive of the skin 26. Preferably the bottom of the core 20 is flush with the bottom of the reinforcing panel 24, the skin 26 being substantially planar and also extending in contact with and being bonded to the underside of the reinforcing panel 24, the core 20 also having a thickness under the floor portion 14 that corresponds to the thickness TR of the reinforcing panel 24. It will be understood that other shapes of the shell member 12 are contemplated within the scope of the present invention, the size of the pond structure 10 being characterized by an inside volume of the shell member 12, and more particularly by the height h times the area corresponding to the average inside diameter d. In the exemplary circular configuration of the pond apparatus 10 shown in FIGS. 1–3, the outside diameter DO can range from approximately 3 feet to approximately 25 feet, the height H being not less than about 8 inches in smaller sizes, on the order of 18 inches in larger sizes of the apparatus, the width w being on the order of 3 inches. Advantageously, when the outside diameter is 50 inches, the pond apparatus 10 weighs only approximately 100 pounds, a fraction of the over 400 pounds that is typical of conventional concrete ponds. Also, the weight is only approximately 150 pounds when the outside diameter DO is increased to 88 inches, the weight being only about 15 to 25 percent of comparable concrete ponds. In the exemplary circular configuration of FIGS. 1–3, the pond apparatus 10 may be moved by raising it to a vertical orientation and rolling the outside wall portion 17 along a soft surface provided by carpeting, moving blankets, or the like.

The reinforcing panel 24 can have any suitable perimeter outline such as curved or polygonal, an exemplary square outline of width WR being shown in FIG. 2, the panel 24 having a diagonal major dimension MR being approximately 1.414 times the width WR in that case. In round configurations, the reinforcing panel can have a diameter from less than 1 foot to approximately 4 feet, depending on the configuration of the fountain or other load to be supported. Suitable materials for the reinforcing panel 24 include particle board which is preferred, plywood, rigid plastic, and reinforced concrete. The thickness TR of the reinforcing panel 24 can be from approximately 1.25 inch to more than 2 inches, approximately 1.5 inches being preferred in configurations having the outside diameter D not exceeding approximately 16 feet, somewhat greater thicknesses being preferred when the reinforcing panel 24 is reinforced concrete.

Suitable materials for the shell member 12 include fiberglass-reinforced plastic, the thickness t of the shell member 12 being between approximately 0.015 inch to approximately 0.4 inch, depending on the inside volume. For example, the above-described exemplary thickness t of 0.25 inch is preferred for configurations having the diameter D between approximately 4 feet and approximately 10 feet, the inside height h being from approximately 6 inches to approximately 10 inches. Suitable materials for the core 20 include urethane foam (preferred) and Styrofoam® (Dow Chemical Co.). Suitable materials for the skin 26 include sand dispersed in a hardened polymer, which can urethane, polyester resin or epoxy (including layers of different materials).

Preferably the pond apparatus 10 has a fluid passage 30 that extends through the floor portion 14 of the shell member 12 and into the reinforcing panel 24. In the exemplary configuration shown in FIGS. 1–3, the fluid passage 30 extends laterally from the reinforcing panel 24 into the core 20, then upwardly through the floor portion 14 for being suitably coupled to an outlet port 32 of a submersible pump 34 that is supported on the floor portion 14 proximate the inside wall portion 15. As shown in FIG. 3, the fluid passage 30 is formed by a section of pipe 36 having respective elbow fittings 38 joined at opposite ends thereof, the fittings 38 sealingly projecting through the floor portion 14 of the shell member 12. The pipe 36 and fittings 38 can be formed of polyvinyl chloride (PVC), being either threaded or sealingly joined using a suitable adhesive in a conventional manner. A feed hose 39 is connected to the pump outlet port 32 and one of the elbow fittings 38, which can be of the type having one threaded end, and another hose (not shown) can be connected between the other fitting 38 and the fountain or other appliance to be supported within the apparatus 10. Alternatively, the feed hose 39 can extend through the fluid passage 30 to the fountain. The reinforcing panel 30 can be slotted (optionally through, or part way through with a central through clearance opening as shown in FIG. 3) for receiving the pipe 36 and one of the elbow fittings 38. When the reinforcing panel 24 is made of reinforced concrete, the pipe 36 and the one elbow fitting 38 can be cast in place, the pipe 36 having a coupling (not shown) at a side extremity of the panel 24 for facilitating assembly.

A tubular conduit 40 also sealingly projects through the inside and outside wall portions 15 and 17 (and the core 20) for passage of a power cord 42 from the pump 34 to outside of the apparatus 10, a sealant plug 44 being formed about the cord 42 and into the conduit 40 for preventing water leakage through the conduit 40. Also, a formed cover 46 is positioned for hiding the pump 34 and portions of the power cord 42 and the feed hose 39 that would otherwise be exposed to view within the apparatus 10. The cover 46 can have a decorative shape, such as for simulating a rock.

The pond apparatus 10 can be installed on a level concrete surface, without shims, or on bare ground that is preferably covered with a level 2-inch thick layer of sand.

With further reference to FIGS. 4–8, a method for fabricating the apparatus 10 in a variety of shapes includes providing a mold structure 50 including a table 51 having a platform 52, mounting a mold core 54 on the platform, the mold core being shaped for forming the floor and inside wall portions 14 and 15 of the shell member 12 in an inverted orientation, the rim portion 16 to be formed directly on the platform 52 as best shown in FIG. 8. The mold core 54 is fastened to the platform 52 by a plurality of fasteners 55. A mold ring 56 is then mounted to the platform 52 (using additional fasteners 55) in spaced relation to the core 54 for forming the outside wall portion 17 of the shell member 12. As variously shown in FIGS. 4–7, the mold ring 56 is preferably modular, including a plurality of mold segments 58 that are separately mounted to the platform 52. The shell member 12 is formed by applying a paste composition to shape-defining surfaces of the mold structure, then bonding fiberglass cloth or matting to the paste, which can permeate the cloth. In one preferred variation, the paste, which can be a mixture of urethane casting material, milled fiber, Cabicil and silica sand, is allowed to harden, and 1.5-ounce fiberglass matting is applied with a quantity of polyester resin, the resin being rolled into the matting and coating the solidified paste, and any PVC fittings such as the elbow fittings 38 that are being bonded to the floor and inside wall portions of the shell structure.

In order to facilitate formation of the shell member 12, the mold structure 50 is initially only partially assembled with the mold core 54 being fastened to the platform 52 during formation of the floor and inside wall portions 14 and 15 of the shell member 12, a control ring (not shown) being placed on the platform 52 surrounding the mold core 54 to restrict outward migration of the paste and the polyester resin. Also, the reinforcing panel 24 is bonded to the floor portion 14 at this stage, and the pipe 36 and elbow fittings are imbedded in place with polyester resin and 2-ounce fiberglass matting, with a fresh coating of additional resin being applied to all surfaces of the panel 24. Further, the segments 58 of the mold ring 46 are separately arranged on a temporary supporting surface (which can be a rolling cart), and additional paste composition for the outside wall portion 17 is applied. Next, after removing the control ring, the mold ring segments 58 are transferred to the platform 52 to complete the mold structure 50 by forming the mold ring 56, and the rim and outside wall portions 16 and 17 are completed by applying more of the paste composition to the platform 52 between the mold core 54 and the mold ring 56 and covering all seams of the mold ring 56, with additional fiberglass matting and polyester resin applied to the paste and bridging between the inside and outside wall portions 15 and 17. Preferably the conduit 40 is sealingly bonded to the shell structure 12 with further quantities of polyester resin, with reinforcement between the inside and outside wall portions by 2-ounce fiberglass matting.

Figure 4:
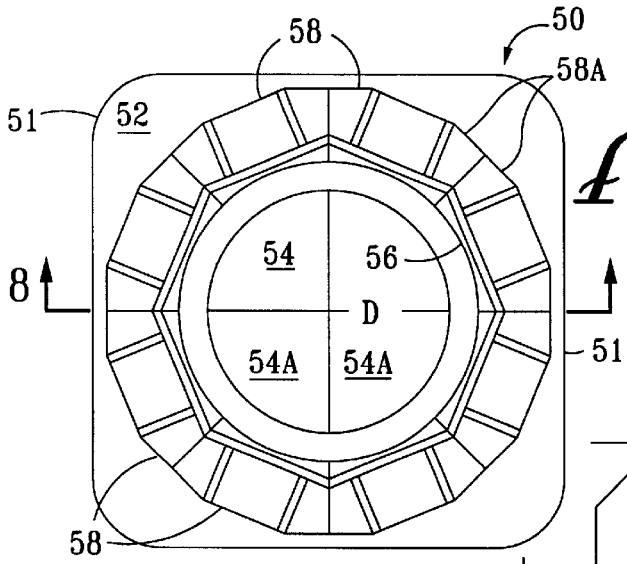
FIG. 4 is a plan view of a mold apparatus suitable for forming the pond apparatus of FIG. 1.

For the previously described circular configuration of the pond apparatus 10, the mold core 54 is circular, preferably being formed as a pair of semicircular core segments 54A as indicated in FIGS. 4 and 8. It will be understood that surfaces of the mold core 54 that form the inside wall portion 15 of the shell member 12 typically have a slight draft angle whereas facing extremities of the core segments 54A are closely fitted to form a fine parting line. In this configuration the mold ring 56 is also circular, the ring segments 58 being arcuate ring segments 56A. Preferably an even number of the arcuate ring segments 58A forms a complete circle, the number being more preferably divisible by four for use of the segments 58A in other configurations of the mold structure 50 that are described below. In the exemplary configuration of FIG. 4, there are eight of the arcuate mold segments 58A.

Figure 5:
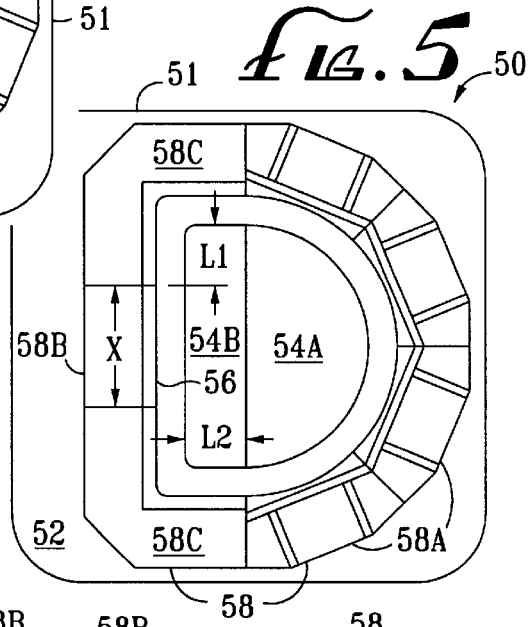
FIG. 5 is a plan view as in FIG. 4, showing an alternative configuration of the mold apparatus of FIG. 4 to produce a different shape of the pond apparatus of FIG. 1.

With particular reference to FIG. 5, another arrangement of the mold structure 50 for forming the pond apparatus 10 in a flat-sided configuration has the mold core 54 including one of the semicircular core segments 54A mounted on the platform 52 adjacent an elongate rectangular side core segment 54B. The mold ring 56 includes a subset (four) of the arcuate ring segments 58A spaced outwardly from the semicircular core segment 54A, one or more (straight) side ring segments 58B being spaced from a major side of the side core segment 54B, and a pair of corner ring segments 58C connecting the side core segment(s) 58B to respective end ones of the arcuate ring segments 58A to complete the mold ring 56. The pond apparatus 10, when formed in the mold structure 50 as configured in FIG. 5, is particularly suited for placement against or adjacent a building wall or fence (not shown).

Figure 6:
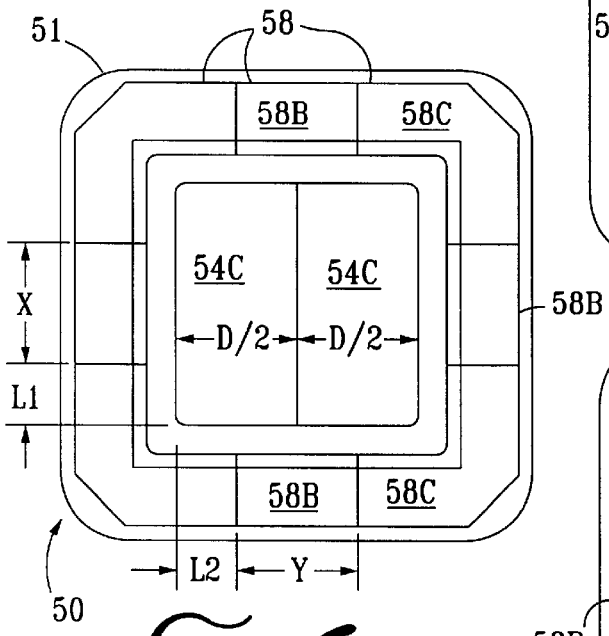
FIG. 6 is a plan view as in FIG. 5, showing another alternative configuration of the mold apparatus of FIG. 4.

In another variation shown in FIG. 6, the mold core 54 is square, having a pair of end core segments 54C of 2:1 aspect ratio, and the mold ring 56 includes four of the corner ring segments 58C that are connected by respective ones of the side ring segments 58B.

Figure 7:
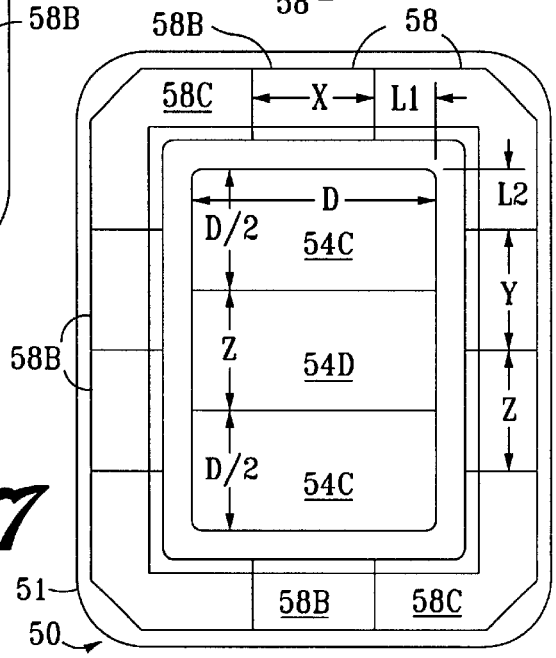
FIG. 7 is another plan view as in FIG. 6, showing a further configuration of the mold apparatus of FIG. 4.

In a further variation shown in FIG. 7, the mold core 54 is rectangular, having a center core segment 54D interposed between the end core segments 54C of FIG. 5, and an additional pair of the side ring segments 58B being spaced from opposite extremities of the center core segment 54D. Preferably the table 51 has the platform 52 configured for mounting the segments of the mold core 54 and the mold ring 56 in more than one of the configurations shown in FIGS. 4–7. Further, other possible configurations of the mold structure 50 can form other shapes of the pond apparatus 10, such as rounded triangular and hexagonal (with the number of arcuate segments being divisible by six); and star-shaped (using inside corner segments, not shown). Moreover, the mold structure 50 can incorporate various combinations of mold elements to produce the pond apparatus 10 incorporating portions of different ones of these and other shapes. Thus the pond 10 can have a generally rectangular shape including one or more quarter-round corner portions, the configuration of FIG. 5 being one such example.

As shown in FIG. 8, the mold core 54 can be shaped to define a radiused (or curved in cross-section) corner contour 59 of the shell member 12 between the inside wall and rim portions 15 and 16, the corner contour being offset from the plane of the rim portion 16 to avoid generation of a parting line along the corner contour 59. Thus the corner contour 59 is stepped approximately 0.25 inch above the platform 52 in the orientation of FIG. 8. Another parting line is formed between the rim portion 16 and the outside wall portion 17 of the shell member 12. However, this parting line is easily smoothed out in that the shell member has a convex form, both circumferentially and radially. Also, the outside wall portion 17 can be contoured as indicated at 60 in FIG. 8, the modular configuration of the mold ring 56 permitting the contour 60 to include negative draft. Suitable construction of the segments of the mold core 54 and ring 56 can include combinations of rigid panels and sheets of wood, particle board, and pressed panels, in combination with hardened clay and/or putty. In particular, the ring segments 58 are shown in FIGS. 4 and 8 to each include a base panel 62, a face panel 63, and a spaced pair of gusset members 64, a molded face member 66 being bonded to the face panel 63 to define a corresponding portion of the outside wall portion 17 of the shell member 12. The fasteners 55 project upwardly through suitably located openings of the platform 52, having threaded engagement with the mold core segments 54 and the ring segments 58. It will be understood that at least some of the fasteners 55 that are used to mount the ring segments 58 can be inverted, projecting through suitable clearance openings formed in the base panels 62 and having threaded engagement with nuts or threaded inserts (T-nuts) being installed in the platform 52. Also, the ring segments can be located by registration pins in place of respective fasteners 55, adjacent ones of the segments being suitably clamped together and/or the base panels 62 being clamped to the platform 52 by ordinary clamps. Thus the term "fastener" is considered to include a registration pin projecting upwardly from the platform 52, in combination with means for holding elements of the mold core 54 and/or the mold ring 56 against the platform 52.

Figure 9:
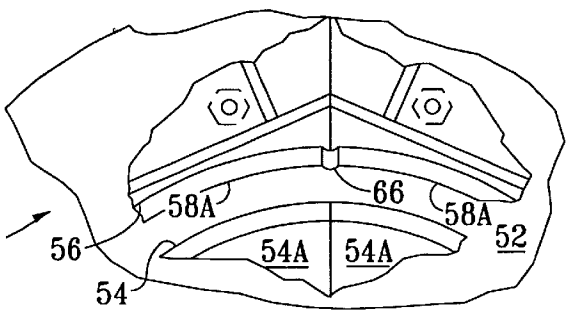
FIG. 9 is a fragmentary plan view of a portion of the mold apparatus of FIG. 4.
Figure 10:
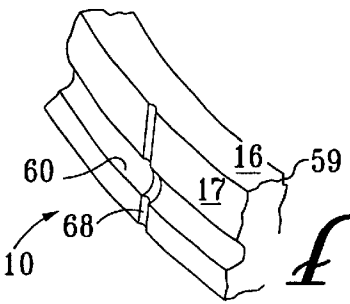
FIG. 10 is a perspective view of a wall portion of the pond apparatus of FIG. 1.

Additional parting lines are formed on the outside wall portion 17 of the shell member 12 along boundaries between the ring segments 58. Preferably these parting lines are obscured by including respective bead strips 66 in the mold structure, the bead strips 66 covering cracks between adjacent ones of the ring segments 58 as shown in FIG. 9, and producing respective vertically oriented grooves 68 in the outside wall portion of the shell member 12 as shown in FIG. 10. Although each of the bead strips 66 produces a spaced pair of parting lines, these parting lines are less prominent, and they are more easily smoothed out than a the single parting lines that they replace, because the bead members 66 produce a relatively sharp convex circumferential cross-section along the pairs of parting lines.

Although the present invention has been described in considerable detail with reference to certain preferred versions thereof, other versions are possible. For example, the passage 30 can extend vertically through the reinforcing panel 24 and the skin 26, being formed by a PVC pipe coupling. Also, the reinforcing panel 24 can be L-shaped in elevation, an upstanding portion extending between straight portions of the inside and outside wall portions 15 and 17 when it is desired to locate the fountain 11 or other load proximate one side of the pond apparatus 10, such as when the pond apparatus is to be located against a fence or building wall. Further, the mold ring 56 of the mold structure 50 can be formed as a single unit having a flexible mold skin that is bonded to a compressible foam to permit release of the molded shell member 12 when the outside wall portion 17 is contoured with negative draft. In another variation, a removable reinforcing band surrounds a stretchable contoured member of the mold ring 56, and the mold skin can further define the rim portion 16 and the inside wall and floor portions 15 and 14 as well for completely eliminating parting lines on the shell member 12. Moreover, the conduit 40 can be installed through the floor portion 14 of the shell member 12 and the skin 26 for the power cord 42, or to form a drain; in fact, a pair of such conduits 40 can serve both purposes. Therefore, the spirit and scope of the appended claims should not necessarily be limited to the description of the preferred versions contained herein.

What is claimed is:

1. A composite pond apparatus for holding pond water and a rigid load to be supported by a submerged portion of the apparatus, comprising:

(a) a shell member having a floor portion and an upstanding inside wall portion;

(b) a lightweight core material bonded to the shell member under the floor portion and outside of the inside wall portion thereof; and (c) a panel member extending within the core material for reinforcing the floor portion of the shell member under the rigid load member.

2. The pond apparatus of claim 1, wherein the shell member further comprises a rim portion projecting outwardly from the inside wall portion, and an outside wall portion extending downwardly from an outer perimeter of the rim portion, the core material also being bonded to the rim and outside wall portions of the shell member.

3. The pond apparatus of claim 2, further comprising a protective base skin extending under the panel member and covering the underside of the core material, the base skin being sealingly bonded to the core material and the outside wall portion of the shell member.

4. The pond apparatus of claim 3, wherein the base skin comprises sand dispersed in a hardened polymer.

5. The pond apparatus of claim 4, wherein the polymer of the skin comprises a material selected from the group consisting of urethane, polyester resin and epoxy.

6. The pond apparatus of claim 2, wherein a first region of the outside wall portion of the shell member slopes downwardly and inwardly for producing a decorative appearance.

7. The pond apparatus of claim 6, wherein a second region of the outside wall portion of the shell member slopes downwardly and outwardly below the first region for enhancing the decorative appearance.

8. The pond apparatus of claim 1, wherein the shell member comprises a hardened polymeric paste.

9. The pond apparatus of claim 8, wherein the shell member further comprises a granulated material dispersed in the paste.

10. The pond apparatus of claim 8, wherein the shell member further comprises fiberglass fibers dispersed in the paste.

11. The pond apparatus of claim 8, wherein the polymeric paste comprises a two-part casting urethane.

12. The pond apparatus of claim 1, wherein the core material comprises a hardened foam polymer.

13. The pond apparatus of claim 12, wherein the foam polymer is selected from the group consisting of urethane foam and styrofoam.

14. The pond apparatus of claim 1, having a passage formed through the floor portion of the shell member over the panel member, the passage extending within the panel member for carrying a liquid to be dispensed from the load.

15. The pond apparatus of claim 14, wherein the passage is formed within a tubular member, the tubular member sealingly projecting through the floor portion of the shell member.

16. The pond apparatus of claim 14, wherein the passage extends laterally from the panel member within the core material and again through the floor portion of the shell member at a location laterally displaced from the panel member for passage of the liquid from a supply of the liquid being contained by the shell member.

17. The pond apparatus of claim 16, further comprising a submersible pump having an outlet, and means for fluid-connecting the outlet to the passage at the location laterally displaced from the panel member.

18. The pond apparatus of claim 17, further comprising a service conduit sealingly connected to the inside wall portion of the shell member and extending outwardly therefrom for receiving a power cord of the pump to be connected through the conduit to an external source of electrical power.

19. A composite pond apparatus for holding pond water and a rigid load to be supported by a submerged portion of the apparatus, comprising:

(a) a shell member having a floor portion, an upstanding inside wall portion, a rim portion projecting outwardly from the inside wall portion, and an outside wall portion extending downwardly from an outer perimeter of the rim portion;

(b) a lightweight hardened foam polymer core material bonded to the undersides of the floor and rim portions, and to facing surfaces of the wall portions of the shell member;

(c) a panel member extending within the core material for reinforcing a the floor portion of the shell member under the rigid load member;

(d) a tubular member forming a U-shaped fluid passage for carrying a liquid to be dispensed from the load, the tubular member extending under the floor portion of the shell member and sealingly projecting therethrough at a first location above the panel member and at a second location laterally displaced from the panel member; and (e) a protective base skin extending under the panel member and covering the underside of the core material, the base skin being sealingly bonded to the core material and the outside wall portion of the shell member.

20. A composite pond apparatus for holding pond water and a rigid load to be supported by a submerged portion of the apparatus, comprising:

(a) a shell member having a floor portion and an upstanding inside wall portion;

(b) a panel member extending under and bonded to a portion of the floor portion for reinforcing the floor portion of the shell member under the rigid load member; and (c) a lightweight core material bonded to the shell member under the floor portion and outside of the inside wall portion thereof.

21. The pond apparatus of claim 20, having a passage formed through the floor portion of the shell member over the panel member, the passage extending within the panel member for carrying a liquid to be dispensed from the load.

22. The pond apparatus of claim 21, wherein the passage is formed within a tubular member, the tubular member sealingly projecting through the floor portion of the shell member and extending laterally from the panel member within the core material and again through the floor portion of the shell member at a location laterally displaced from the panel member for passage of the liquid from a supply of the liquid being contained by the shell member.

23. The pond apparatus of claim 22, further comprising a submersible pump having an outlet, and means for fluid-connecting the outlet to the passage at the location laterally displaced from the panel member.

24. The pond apparatus of claim 23, a further comprising a service conduit sealingly connected to the inside wall portion of the shell member and extending outwardly therefrom for receiving a power cord of the pump to be connected through the conduit to an external source of electrical power.

* * * * *